US009833121B2

(12) United States Patent
Hintz et al.

(10) Patent No.: US 9,833,121 B2
(45) Date of Patent: Dec. 5, 2017

(54) DISHWASHER WITH SELF-SEALING VENT FAN

(75) Inventors: Michael K. Hintz, Waukesha, WI (US); Jeffrey J. Krieger, Mukwonago, WI (US); Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 768 days.

(21) Appl. No.: 14/238,828

(22) PCT Filed: Aug. 14, 2012

(86) PCT No.: PCT/US2012/050683

§ 371 (c)(1),
(2), (4) Date: Feb. 13, 2014

(87) PCT Pub. No.: WO2013/025668

PCT Pub. Date: Feb. 21, 2013

(65) Prior Publication Data

US 2014/0170954 A1 Jun. 19, 2014

Related U.S. Application Data

(60) Provisional application No. 61/523,599, filed on Aug. 15, 2011.

(51) Int. Cl.
*A47L 15/48* (2006.01)

(52) U.S. Cl.
CPC ..... *A47L 15/48* (2013.01); *A47L 15/486* (2013.01); *A47L 15/488* (2013.01); *A47L 15/483* (2013.01)

(58) Field of Classification Search
CPC ..... A47L 15/48; A47L 15/486; A47L 15/488; A47L 15/483
USPC ..... 454/251, 259, 341, 353, 370; 134/57 D, 134/58 D
See application file for complete search history.

(56) References Cited

U.S. PATENT DOCUMENTS 2,616,356 A * 11/1952 Cunningham ..... F04D 25/14 219/472
3,917,433 A * 11/1975 Tomitaka ..... F04D 25/14 415/148
4,055,113 A * 10/1977 Monroe ..... F24F 7/025 310/209
4,217,816 A * 8/1980 Mancinelli ..... F04D 25/14 415/125
5,660,195 A * 8/1997 Taylor, Jr. ..... A47L 15/4257 134/183

(Continued)

FOREIGN PATENT DOCUMENTS

EP 0521815 A1 1/1993
EP 0793940 A1 9/1997

(Continued)

OTHER PUBLICATIONS

ISR for PCT/US2012/050683 dated Jan. 25, 2013.

*Primary Examiner* — Gregory Huson
*Assistant Examiner* — Dana Tighe
(74) *Attorney, Agent, or Firm* — Boyle Fredrickson, S.C.

(57) ABSTRACT

A vent fan for use with the dishwasher and providing a vent door covering the opening associated with a motorized fan employs a mechanical coupling between the fan motor and vent door to eliminate the need for a separate vent door actuator by using energy of the fan motor to accomplish the actuation.

20 Claims, 12 Drawing Sheets

(56) References Cited

U.S. PATENT DOCUMENTS

| | | | | |
|---|---|---|---|---|
| 7,695,572 | B2 * | 4/2010 | Ahn | A47L 15/0002 134/102.1 |
| 2009/0114252 | A1 | 5/2009 | Robert et al. | |

FOREIGN PATENT DOCUMENTS

| | | | |
|---|---|---|---|
| EP | 1230891 | A1 | 8/2002 |
| WO | 02074154 | A1 | 9/2002 |

* cited by examiner

DISHWASHER WITH SELF-SEALING VENT FAN

CROSS REFERENCE TO RELATED CASE

This application is a National Phase of International Application Number PCT/US2012/050683 filed Aug. 14, 2012 and claims the benefit of U.S. provisional application 61/523,599 filed Aug. 15, 2011 hereby incorporated by reference.

FIELD OF THE INVENTION

The present invention relates to dishwashers and other appliances and in one embodiment to dishwashers providing forced airflow during the drying cycle.

BACKGROUND OF THE INVENTION

Dishwashers, such as those used in a home, may provide for a washing cycle followed by a drying cycle, the latter intended to dry the washed dishes sufficiently so that they may be immediately removed from the dishwasher and stored without additional manual drying. In many cases, the drying cycle includes activation of a heating element exposed at the bottom of the washing volume to heat the dishes and create an upward convective flow of hot air.

One drawback to vents is that they can increase the noise emitted from the dishwasher during the washing cycle and, accordingly, it is known to provide for vents having an electrically actuable door that may block the vents during the washing cycle thereby cutting emitted noise. One vent of this type is described in U.S. Pat. No. 6,293,289 entitled: "Surge Pressure Vent for Low Noise Dishwasher". Venting can also be obtained by partially opening the door at the conclusion of the washing cycle as disclosed in U.S. Patent Application US 2004/0163684 entitled: "Automatic Door for Dishwasher". Both of these patents are assigned to the assignee of the present invention and hereby incorporated by reference.

Venting systems can be improved by the addition of a blower to increase the passage of air through the washing volume. Generally, such blowers are arranged to reinforce the natural convective flow of air thereby obtaining the benefit from the blower and the convection action of the heated air during the drying cycle.

US patent application 2006/0231122, also assigned to the assignee of the present invention, describes a blower that obtains improved drying efficiency by operating at very low flow volumes in a direction counter to the natural convective flow of the air. This application also describes a vent door actuated by a solenoid or the like.

SUMMARY OF THE INVENTION

The present invention provides a vent door for a dishwasher blower that makes use of the energy of the blower fan to mechanically open or close a vent depending on the direction of that rotary action. In this way, a single electrical actuator (the fan motor) may provide mechanical energy both to turn the fan and to open and close the door eliminating the need for separate wiring for the fan and the door actuator. A direct mechanical coupling between the fan motor and the vent door permits a greater degree of opening and less back pressure than would be obtained, for example, in a design using air pressure to open the door. In addition, the greater strength of the motor permits a more positive sealing of the door for water tightness as well as acoustic damping.

Specifically, the invention provides a dishwasher vent having a housing with an inlet adapted to communicate with a washing volume for receiving dishes, and an outlet communicating with air outside of the dishwasher. The housing includes a channel for permitting airflow therethrough between the inlet and outlet. An electrical motor provides a rotating shaft extending along an axis attached to a fan positioned within the channel and rotatable in a first direction to move air through the channel from the inlet to the outlet. A vent door is provided that is movable between a closed position blocking the channel to prevent airflow therethrough and a open position opening the channel to permit airflow therethrough and a mechanical coupling is positioned between the motor and the vent door to cause rotation of the electrical motor driving the fan in the first direction to open the vent door.

It is thus a feature of at least one embodiment of the invention to eliminate the need for a separate vent door actuator while providing positive actuation displacement without the backpressure, and hence reduction in airflow, produced by a system where air pressure must be used to open the vent door.

The mechanical coupling may further cause rotation of the electrical motor to drive the fan in a second direction opposite the first direction to close the door.

It is thus a feature of at least one embodiment of the invention to use the same motor for a positive sealing of the vent door to provide improved resistance to sound and/or water leakage.

The dishwasher vent may further include a vent control providing a first polarity of electrical power to the electrical motor to cause the fan to move in the first direction when venting of the dishwasher is to occur and providing a second opposite polarity of electrical power to the electrical motor to cause the fan to move in the second direction when washing of dishes within the dishwasher is to occur.

It is thus a feature of at least one embodiment of the invention to permit motorized opening and closing of the vent door without the need for multiple wire pairs.

The mechanical coupling may be a collar fitting about a threaded shaft attached to the motor.

It is thus a feature of at least one embodiment of the invention to provide a simple coupling mechanism that may be tailored to produce the desired mechanical advantage and speed reduction necessary for using one motor for both a fan and a door actuator.

The collar may attach to a center of the vent door to move the vent door to engage or disengage from a vent door seat concentric about the fan with rotation of the motor.

It is thus a feature of at least one embodiment of the invention to permit mechanical coupling to provide both the motivation to and support for the vent door.

The threaded shaft may provide a non-threaded portion allowing rotation of the threaded shaft without movement of the collar in at least one extreme position of the collar with respect to the threaded shaft.

It is thus a feature of at least one embodiment of the invention to provide a vent cover that may be controlled in an "open loop" fashion in which the motors run for a predetermined period of time to ensure its opening or closing without the need for limit switches or the like.

Alternatively, the vent may include a spring element urging the vent door to the closed position when no power is applied to the electrical motor.

It is thus a feature of at least one embodiment of the invention to provide a vent door that may be operated with a unipolar control voltage whose absence serves to close the door. It is a further feature of at least one embodiment of the invention to provide a default door closure position desirable for shipping and the like when no power is applied to the dishwasher.

The vent door may be a plate slidable along the axis to cover or uncover an orifice in the housing.

It is thus a feature of at least one embodiment of the invention to provide a low-profile vent door and fan combination for use where space is at a premium, for example, at the top of the dishwasher for updraft venting.

The plate may include multiple openings spaced along the axis and the orifice includes multiple apertures spaced along the axis so that movement of the plate with respect to the orifice by a distance equal to the spacing between openings and apertures may move the vent door from a full open to a full close position.

It is thus a feature of at least one embodiment of the invention to permit a large open area of the event with relatively small amounts of plate movement.

The mechanical coupling may be a collar fitting about the threaded shaft attached to the motor and the vent cover and fan may be joined to a collar to rotate together. Rotation of the vent cover and fan in an open position then move air through the channel from the inlet to the outlet.

It is thus a feature of at least one embodiment of the invention to provide apparatus of limiting the need for separate vent cover and fan structure.

Other features and advantages of the invention will become apparent to those skilled in the art upon review of the following detailed description, claims and drawings in which like numerals are used to designate like features.

Figure 1:
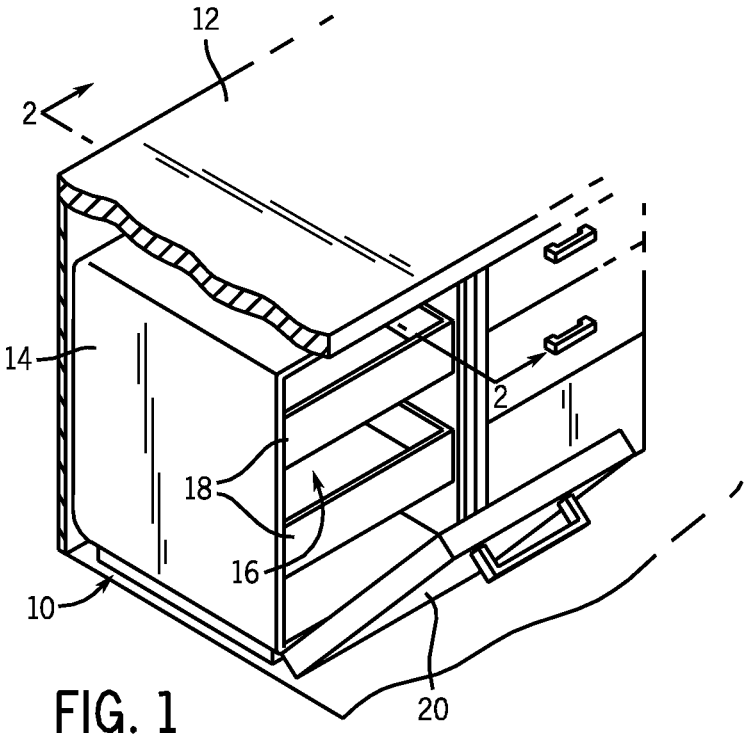
FIG. 1 is a perspective view of a standard residential dishwasher as positioned beneath a counter, the latter shown in cutaway and with the door opened.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

Referring now to FIG. 1, a dishwasher 10 for fitting beneath a countertop 12 may include a cabinet 14 enclosing a washing volume 16. The washing volume 16 may hold one or more racks 18 into which dishes may be loaded for cleaning as accessed through a front opening closeable by a door 20.

Figure 2:
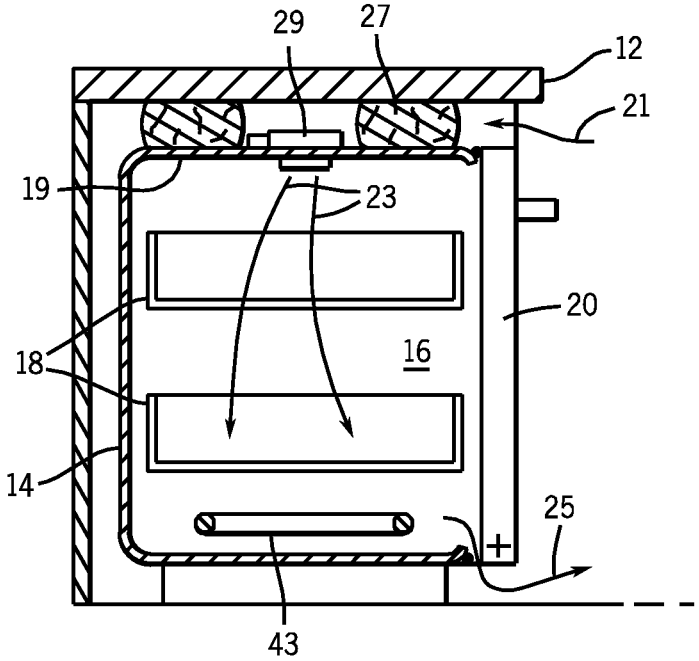
FIG. 2 is a cross-sectional view through the dishwasher of FIG. 1 along lines 2-2 of FIG. 1 showing the door closed and a first embodiment of the invention providing counter-convection airflow using a top mounted intake fan.

Referring also to FIG. 2, the door 20 may be closed against door seals to contain water within the washing volume 16 during a wash cycle. During a wash cycle, heated water is sprayed on the dishes within the washing volume 16 by stationary or movable nozzles (not shown). At the conclusion of the wash and rinse cycles as determined by a cycle timer (not shown), water is drained from the lower portion of the washing volume 16 in preparation for drying of the dishes and, in a first embodiment of the invention, a heater element 43 is activated heating the air within the washing volume 16.

At this time the cycle timer activates a vent fan assembly 29 positioned at a vent opening in a roof 19 of the cabinet 14 drawing intake air 21 from outside the washing volume 16 beneath a countertop 12 to produce a counter-convection or downward airflow 23 within the washing volume 16 with the air ultimately exhausting through the lower vent at the lower edge of the door 20 to flow along the floor as exhaust airflow 25. Notably, no moist air is injected in between the dishwasher 10 and the countertop 12 or under other cabinet areas. The downward airflow 23 serves to preferentially exhaust the air at the bottom of the washing volume 16.

Filtration of the intake air 21 may be provided by sound insulating batting 27, for example, also serving to reduce the sound emitted by the dishwasher 10 and being, for example, a fiberglass mat or the like wrapped around the cabinet 14 and beneath the countertop 12. Alternatively, a dedicated filter to be described can be used.

Figure 3:
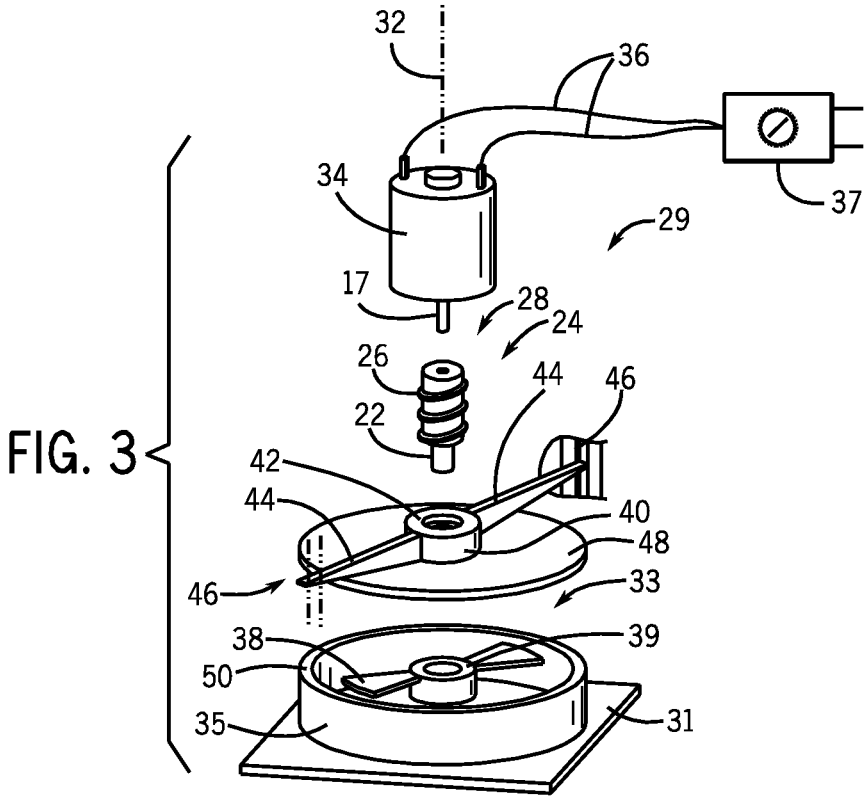
FIG. 3 is an exploded perspective view of a dishwasher vent according to the present invention showing a helix drive, an elastomeric valve disk, a fan, and a valve seat/shroud arranged along an axis of a motor shaft.

Referring now to FIG. 3, a vent fan assembly 29 of the present invention may provide a housing 31, for example, having a lower wall being flush with an upper inner wall of the roof 19 of the dishwasher 10. The housing 31 may have a passageway 33 through the housing 31, the opening surrounded by a circular shroud/valve seat 35, for example, in the form of a cylindrical tube. The shroud/valve seat 35 may surround a fan 38 having a hub 39 concentric within the shroud/valve seat 35 to rotate therein to move air through the passageway 33 when rotated.

The hub 39 of the fan 38 may be received on a downwardly extending post 22 of a helical drive 24, the main body of the helical drive 24 being a cylinder having an outer helical thread 26 spiraling counterclockwise downward.

A socket 28 in the upper end of the helical drive 24, in turn, may be received by a motor shaft 17 oriented generally along the vertical axis 32 and rotatable by a DC electric motor 34. It will be understood that the DC electric motor 34 may be rotated in either of two directions simply by reversal of the polarity of the driving voltage provided on a single pair of wires 36 attached to the DC electric motor 34. The wires 36 may attach to a cycle timer 37 of a type known in the art that may provide either a timed unipolar voltage pulse or timed bidirectional voltage pulses as will be described.

A threaded collar 40 may fit about the helical drive 24 between the DC electric motor 34 and the fan 38 and may include inner threads 42 engaging the threads 26 of the helical drive 24 when the collar 40 is at middle positions along the helical drive 24 but disengaging from the threads 26 at the top and bottom extent of its travel along the helical drive 24.

The collar 40 may have radially outwardly extending arms 44 received by vertically extending grooves 46 attached to the housing 31 and generally parallel to the axis 32. An interfitting between the arms 44 and grooves 46 prevents rotation of the collar 40 with rotation of the helical drive 24 from frictional engagement between the helical drive 24 and the collar 40 while allowing movement of the collar 40 along the axis 32. Rotation of the helical drive 24 moves the collar 40 up or down to limits of this travel defined by this engagement between the inner threads 42 and the threads 26.

A bottom surface of the collar 40 may be attached to an elastomeric valve disk 48 sized to have a diameter slightly larger than the shroud/valve seat 35 so that when the collar 40 is in its lowermost extreme position it fits against an upper lip 50 of the shroud/valve seat sealing the same and preventing sound and moisture from passing from inside the dishwasher through the passageway 33.

Figure 4:
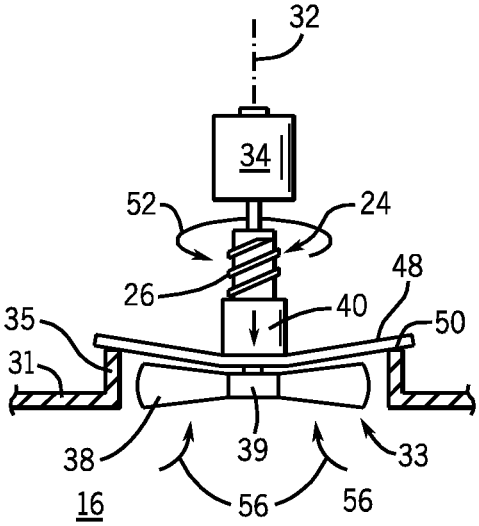
FIG. 4 is a side elevational view in partial cross-section of the vent as assembled showing operation of the motor in a counterclockwise direction to close a vent door.
Figure 6:
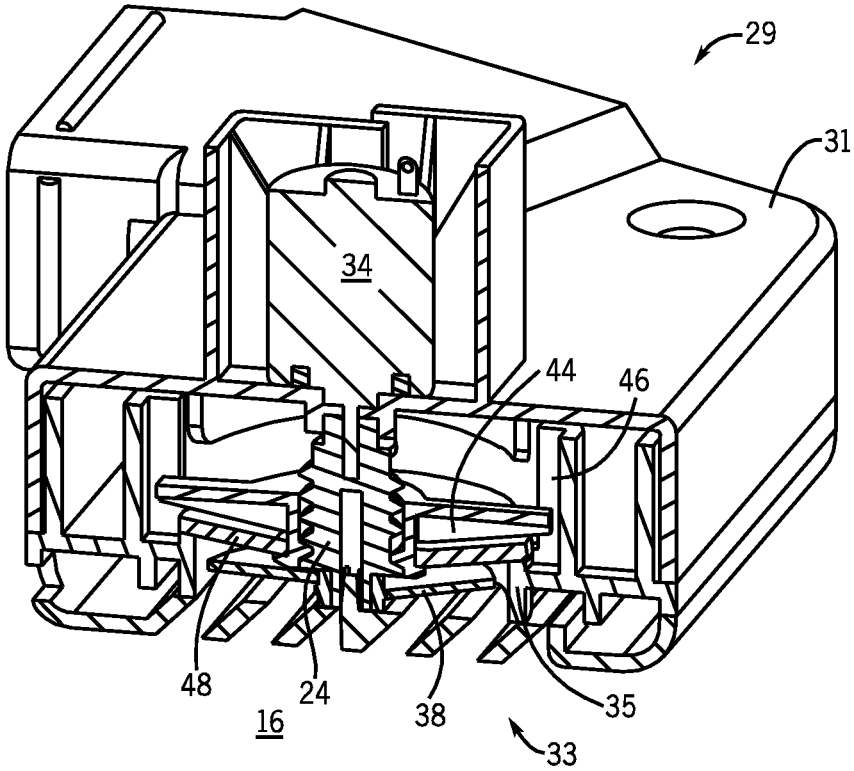
FIG. 6 is a figure similar to that of FIG. 4 showing a more detailed embodiment.

Referring now to FIGS. 4 and 6, when the motor 34 is operated in a counterclockwise direction 52, the threads 26 of the helical drive 24 push the collar 40 downward pressing the elastomeric valve disk 48 against the upper lip 50 sealing the housing 31 against moisture passing through the shroud/valve seat 35 and passageway 33. In this position, the fan 38 is isolated from the motor 34 and effectively inside of the dishwasher 10; however, the materials of the fan 38 and the post 22 may be water resistant thermoplastic. In contrast, the electrical components of the motor 34 are protected from water spray in the volume of the dishwasher 10.

When the motor 34 is operated in this counterclockwise direction 52, the pitch of the fan 80 is such as to generally blow upward as indicated by arrows 56. Thus, operation of the motor 34 in a counterclockwise direction may serve to close the vent door. The motor 34 may be stalled at this point of closure (through the use of current limiting resistance) or the threads may disengage as described above allowing free rotation of the helical drive 24. Power may then be removed from the motor 34 with the elastomeric valve disk 48 staying in closed position through the agency of friction and the inertia of the motor or, for tighter seal, a continuous bias voltage may be provided to the motor 34 to press the elastomeric valve disk 48 downward.

Figure 5:
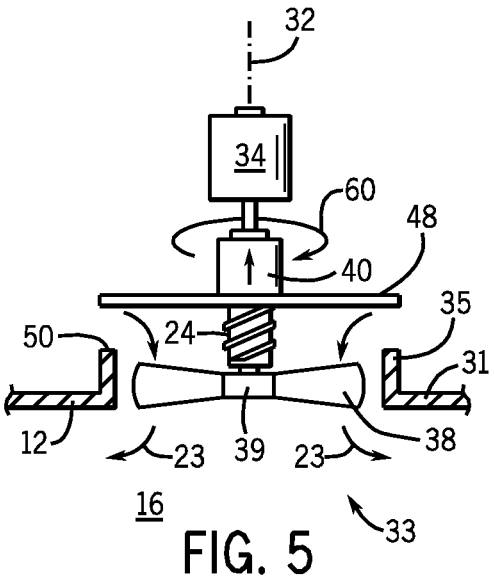
FIG. 5 is a figure similar to that of FIG. 2 showing the motor operated in a clockwise direction to open the vent door and provide for airflow into the dishwasher cavity.
Figure 7:
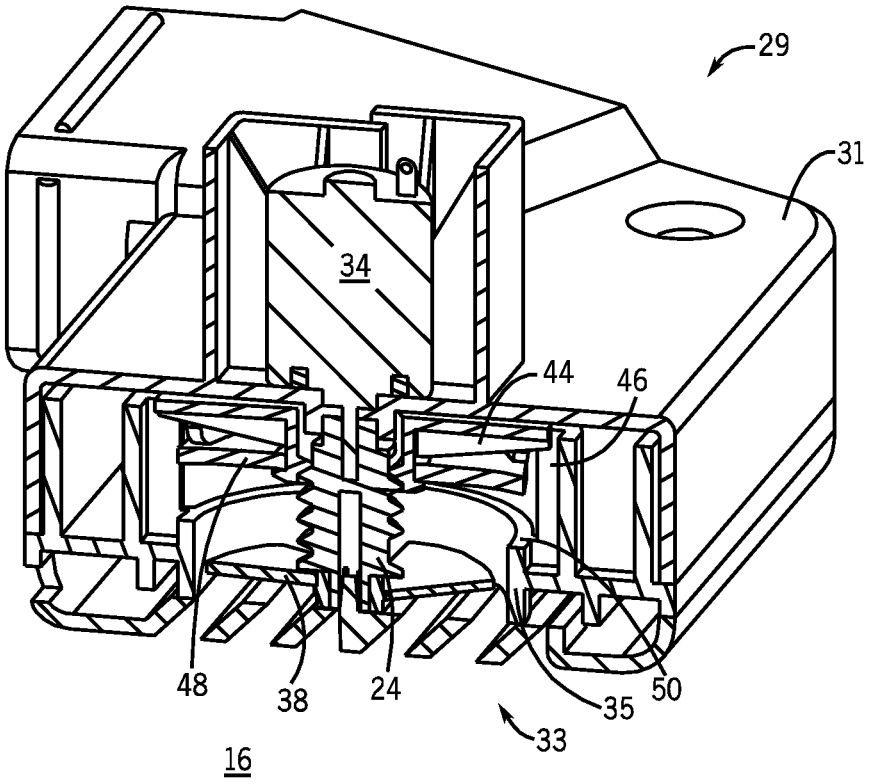
FIG. 7 is a figure similar to that of FIG. 5 showing a more detailed embodiment.

Referring now to FIGS. 5 and 7, a reversal of the motor 34 to a clockwise direction 60 causes the helical drive 24 to pull the collar 40 upward. Initial engagement between the threads of the collar 40 and the helical drive 24 is provided by slight upward biasing of the collar 40 by flexure of the elastomeric valve disk 48 shown in FIG. 4. It will be understood that the elastomeric valve disk 48 may be moved an arbitrarily large distance by proper sizing of the helical drive 24 to provide minimum amounts of air resistance to downward airflow 23 caused by the reversal of the fan 38 to the clockwise direction 60. At this point, air is free to move in through the passageway 33 in the shroud/valve seat 35 out of the dishwasher volume to be exhausted out of the dishwasher through an upper vent in the housing (not shown). It will be understood that the airflow direction may be easily reversed by changing the pitch of the fan 38 and/or that of the threads 26.

Figure 8:
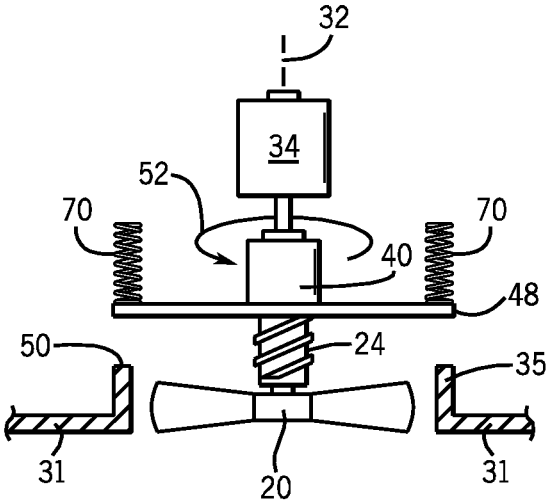
FIG. 8 is a figure similar to that of FIG. 5 showing an alternative embodiment using a spring element for returning the vent door to the closed position.

Referring now to FIG. 8, in an alternative embodiment, springs 70, for example helical compression springs, may be positioned to press downward on the collar 40, for example, by agency of the arms 44 so that when no power is applied to the motor 34 the elastomeric valve disk 48 closes. In this case, the springs 70 cause a torsion on the helical drive 24 through the collar inner threads 42 which provide the necessary rotation 52 to close the elastomeric valve disk 48. An advantage to this design is the ability to operate the motor 34 with only a single polarity of voltage and to firmly retain the elastomeric valve disk 48 in a closed position without electrical power and to be used with an AC or DC motor. This design also permits the use of a brushless DC motor.

Figure 9:
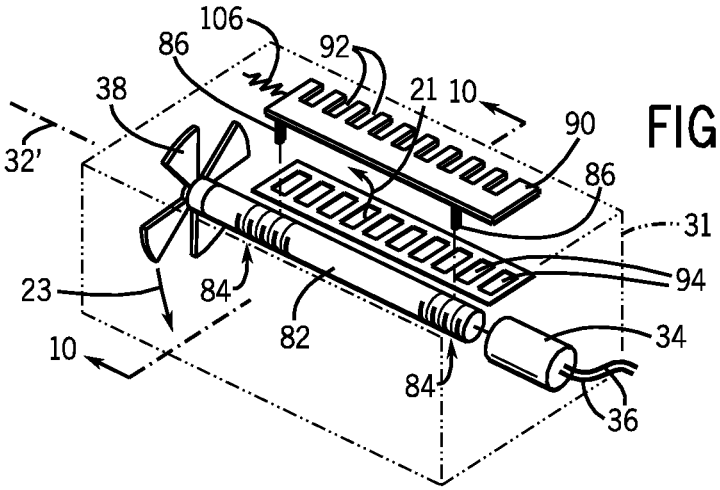
FIG. 9 is an exploded perspective view in partial phantom of an alternative embodiment of the invention employing a horizontal motor and fan axis and a sliding vent plate.

Referring now to FIG. 9, in an alternative embodiment, the axis 32' of the motor 34 may be oriented horizontally or perpendicular with respect to the downward airflow 23. The motor 34 may be joined with the opposed fan 38 (now rotating in a vertical plane) by means of a horizontal driveshaft 82 having threaded portions 84 on opposite ends close to the motor 34 and close to the fan 38. Vertically oriented follower pins 86 may extend downward from opposite ends of a comb-formed vent plate 90 to engage each of the threaded portions 84 respectively.

The comb-formed vent plate 90 may be a generally planar plate aligned with a generally horizontal plane, and extending substantially the length of the driveshaft 82. The comb-formed vent plate 90 may provide for a series of regularly spaced apertures 92 between comb teeth. When the vent plate 90 is in an open position, as moved by the threaded portions 84 acting on the follower pins 86, and when the driveshaft 82 turns so that the fan 38 blows downward airflow 23, each aperture 92 aligns with a corresponding aperture 94 in the housing 31 providing a passageway for air 21.

In contrast, when the driveshaft 82 is turned so that the fan 38 rotates in the opposite direction to pull air from the washing volume 16 of the dishwasher 10, the vent plate 90 is moved to a closed position by the threaded portions 84 acting on the follower pins 86 so that the comb teeth between each aperture 92 each block a corresponding aperture 94 in the housing 31 preventing the flow of air 21 and sealing the washing volume 16 of the dishwasher 10 against the escape of moisture and sound.

Figure 10:
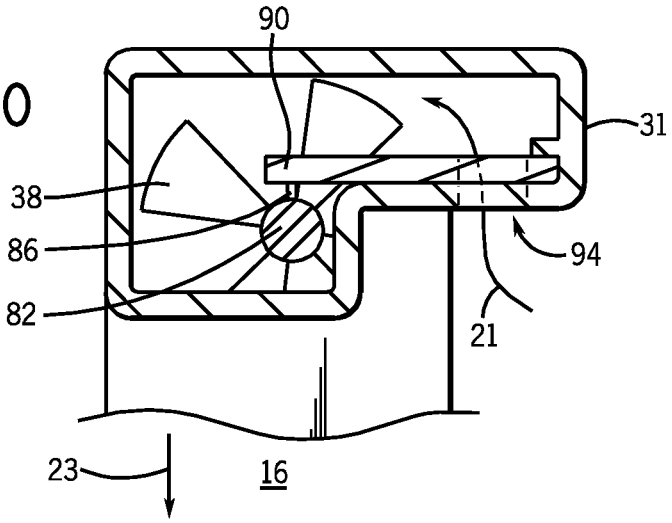
FIG. 10 is a cross-sectional view through the housing and unexploded assembly of FIG. 9 showing airflow therethrough.
Figure 11:
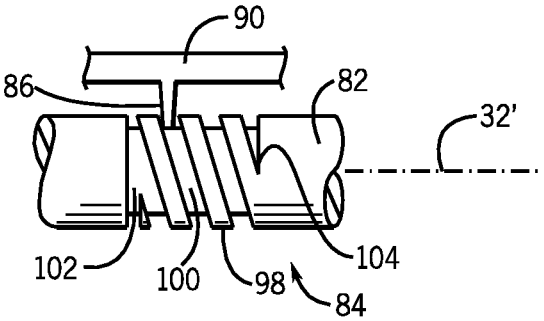
FIG. 11 is a fragmentary detail of a screw thread for moving a sliding plate of FIGS. 9 and 10.

Referring now to FIGS. 8 and 10, the threaded portions 84 may provide for a generally helical thread 98 separated by a helical groove 100 receiving a follower pin 86. When the plate 90 is in the open position allowing free flow of air through the apertures 94 and 92, the follower pin 86 arrives at a circumferential groove 102 communicating with the helical groove 100. The circumferential groove 102 allows continuous rotation of the driveshaft 82 without further movement of the follower pin 86 in a leftward direction (as depicted). The circumferential groove 102 thus permits continuous rotation of the fan 38 in this direction without interference.

When the follower pin 86 is in the circumferential groove 102, and the motor 34 changes direction to move the plate 90 toward the closed position closing the vent, engagement of the follower pin 86 and the helical groove 100 may be promoted through the use of a slight biasing spring 106.

When the plate 90 is in the closed position blocking the free flow of air through apertures 92 and 94, the follower pin 86 arrives at a dead-end 104 of the helical groove 100 and the motor 34 may stall ceasing motion of the fan 38. The resistance of the motor 34 may be adjusted to permit a brief period of stalling without damage, the brief period as controlled by the cycle timer 37 (shown in FIG. 1).

This embodiment may provide for a lower profile of the vent fan assembly 29 helpful when the thickness of the roof 19 of the dishwasher is limited and/or clearance between the dishwasher 10 and the countertop 12 is small (for example, shown in FIG. 1).

While the present invention has been described in the context of a dishwasher, it will be understood that this design can also be used in other appliances where venting is required, including but not limited to, for example, clothes washing machines where the vent fan is used to dry residual water that may otherwise produce unpleasant odors.

Figure 12:
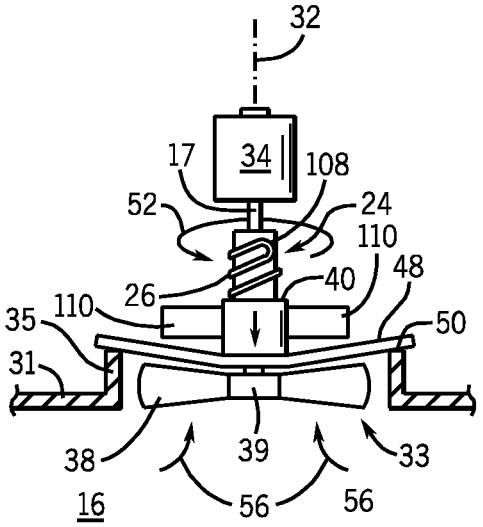
FIGS. 12 and 13 are figures similar to those of FIGS. 4 and 5 showing an embodiment in which the helix drive has a stop to prevent disengagement of the valve disk from the drive at the end of travel and in which air paddles presenting drag forces in the air are used to ensure relative movement between the components of the helix drive without a mechanical keying.
Figure 13:
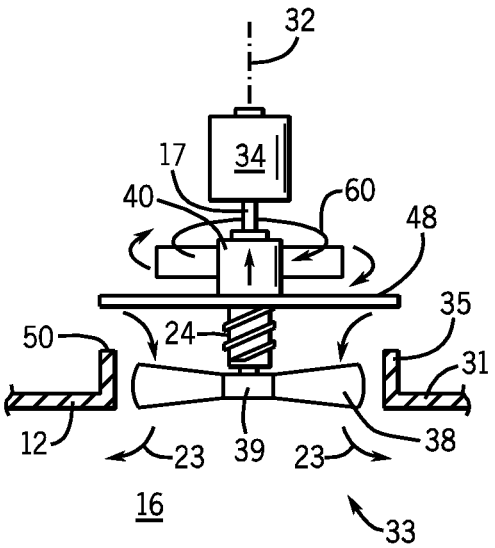

Referring now to FIGS. 12 and 13, in an alternative embodiment, the thread 26 of the helical drive 24 may have a stop 108 preventing the collar 40 from disengaging from the thread 26 at its upper limit of travel when the motor 34 is turning in a clockwise direction. In this embodiment, the collar 40 is not stabilized against rotation by interengaging arms 44 and grooves 46 as shown in FIG. 3 but is free to turn with the motor 34. This permits the collar 40 to rotate with the helical drive 24 when it reaches the upper limit of travel as shown in FIG. 13 and prevents a clicking sound that might otherwise occur were the collar 40 to remain stationary and pressing downward on the truncated end of the thread 26 rotating therebeneath.

Elimination of the inter-engaging arms 44 and grooves 46, requires some means to prevent the collar 40 from rotating with the motor 34 when the motor 34 is operated in a clockwise direction 60 and has not yet reached the upper limits of its travel (for example as shown in FIG. 12) such as would defeat operation of the helical drive 24. Inhibition of rotation of the collar 40 is provided by air paddles 110 extending radially from the collar 40 about axis 32 above the valve disk 48. The air paddles 110 which provide air resistance producing a net rotational speed difference between a collar 40 and threads 26 allowing the collar 40 climb the threads 26 to the point of the stop 108. The air paddles 110 are sized to provide sufficient air resistance for this purpose of allowing the collar 40 to climb the threads 26 but small enough to provide low energy loss in the operation of the motor 34 when the collar 40 is rotating with the motor shaft 17 at the top of its travel.

When the motor 34 is reversed with the shaft 17 traveling in a counterclockwise direction 52, the collar 40 is pressed downward by the threads 26 until the motor stalls as has been described above closing the valve disk 48 against the upper lip 50.

Figure 14:
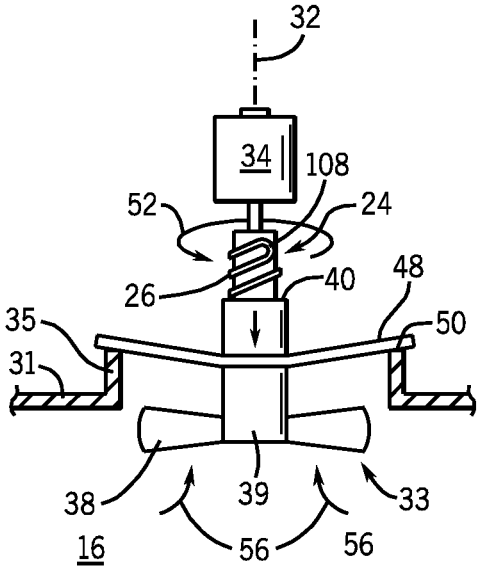
FIGS. 14 and 15 are figures similar to FIGS. 12 and 13 wherein blades of the fan provide the function of the air paddles of FIGS. 12 and 13.
Figure 15:
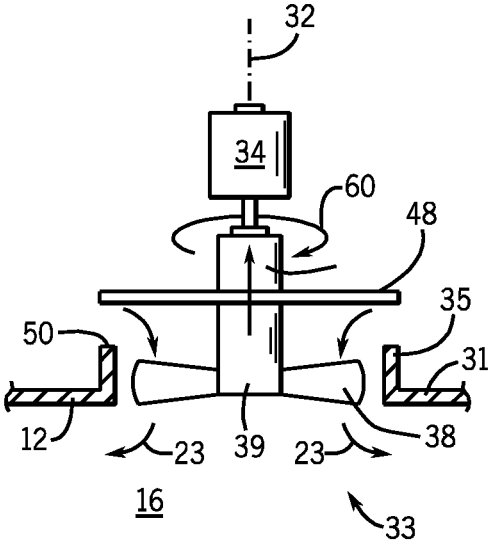

Referring now to FIGS. 14 and 15, this same concept may be implemented by using the blades of the fan 38 as the air paddles 110 and locking the hub 39 and the blades of the fan 38 to the collar 40 to rotate therewith. When the valve disk 48 is in the closed position, as shown in FIG. 14, the fan 38 will be somewhat below the shroud/valve seat 35 but will climb into position as shown in FIG. 15 within the shroud/valve seat 35 as the collar 40 rises on the threads 26 of the helical drive 24. When the internal threads 42 of the collar 40 abut the stop 108, the collar 40 begins to rotate with the motor shaft also causing rotation of the fan 38. In this case there is no unnecessary dissipation of energy into the air as the natural resistance to rotation provided by the fan 38 is an inherent side effect of the useful function of causing airflow 23.

Figure 16:
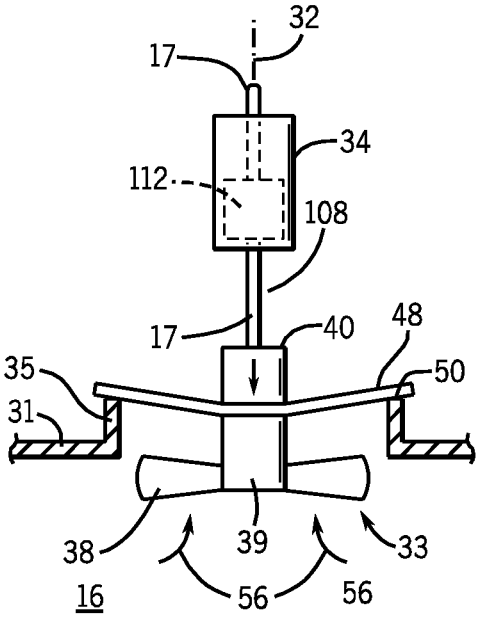
FIGS. 16 and 17 are figures similar to FIGS. 4 and 5 showing an embodiment in which a magnetic centering of the motor rotor within the stator that occurs with energization of the stator motor provides for opening of the valve disk.
Figure 17:
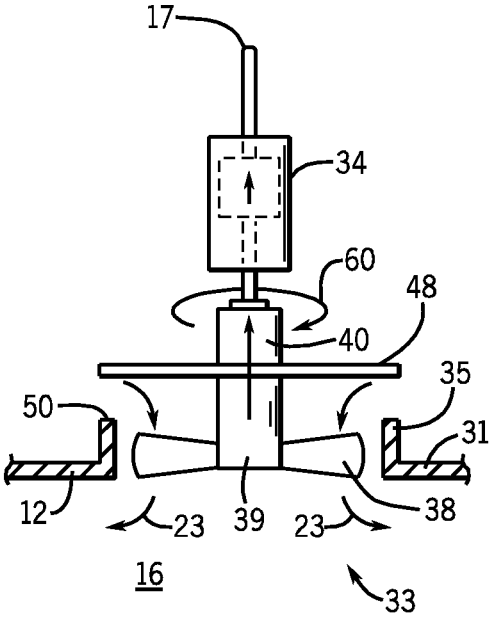
Figure 19:
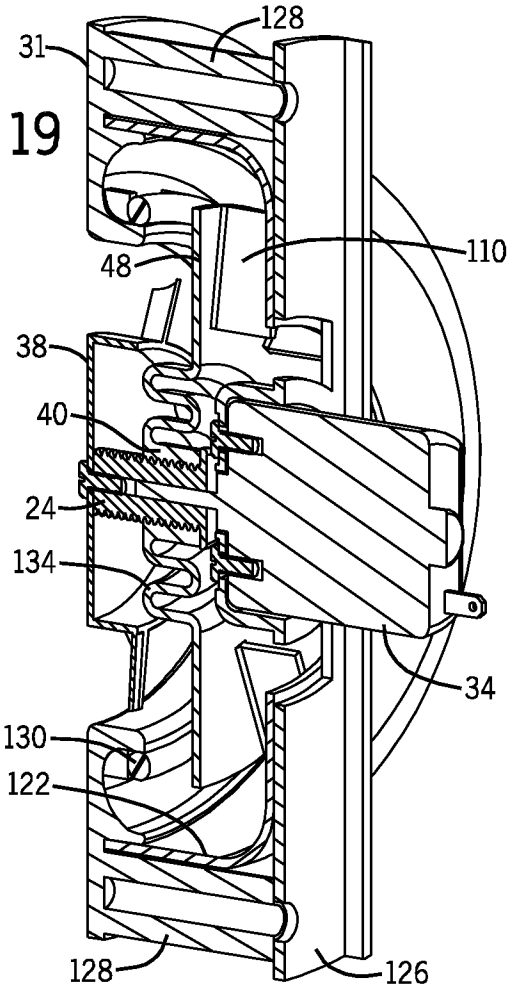
FIG. 19 is a cross-section perspective view of the alternative embodiment of FIG. 18.
Figure 18:
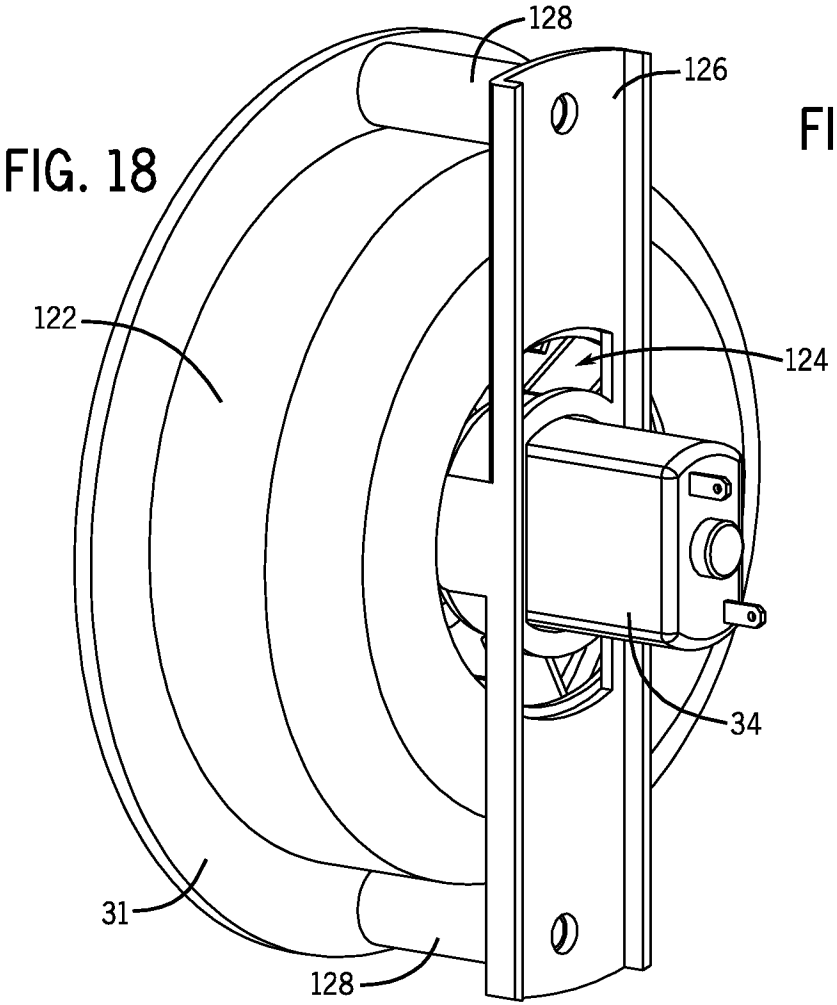
FIG. 18 is an upper perspective view of an embodiment similar to that of FIGS. 12 and 13.
Figure 21:
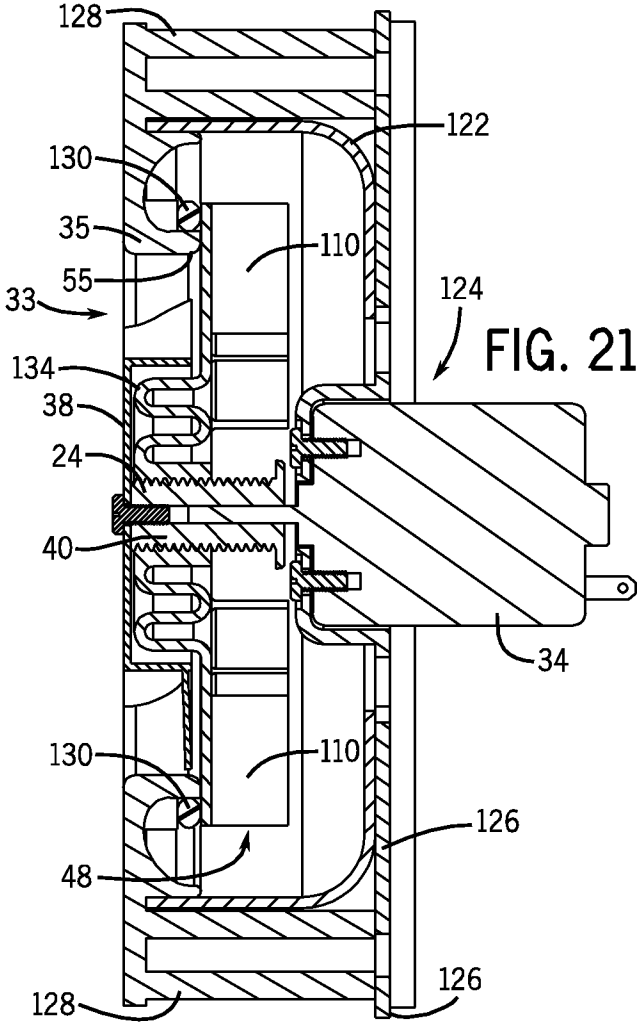
FIGS. 20 and 21 are elevational cross-section views of the embodiments of FIGS. 18 and 19 in an open and closed position, respectively.
Figure 20:
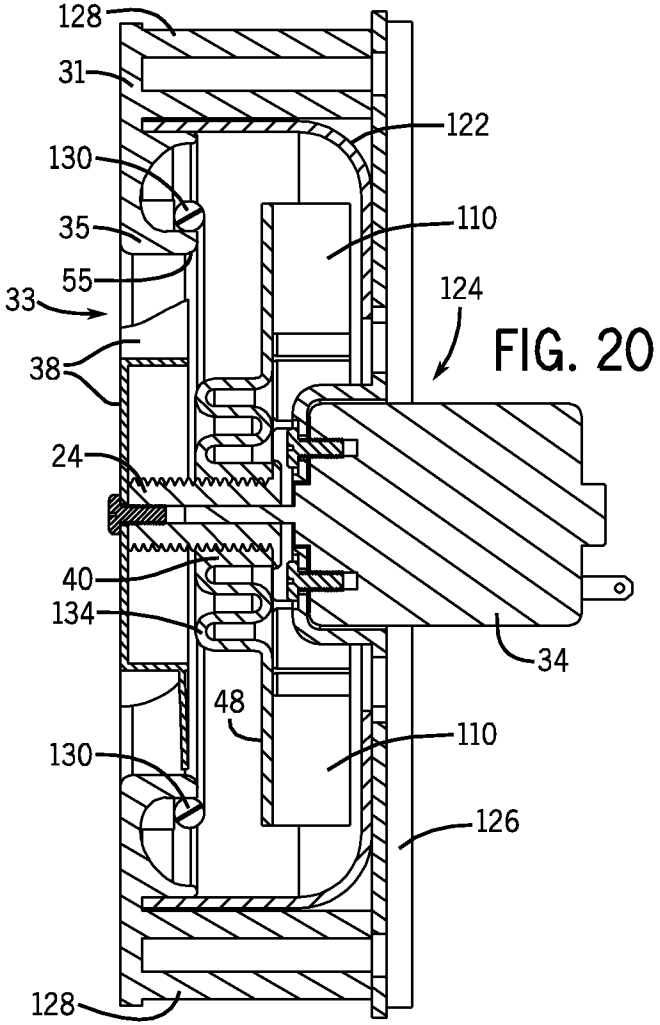
Figure 23:
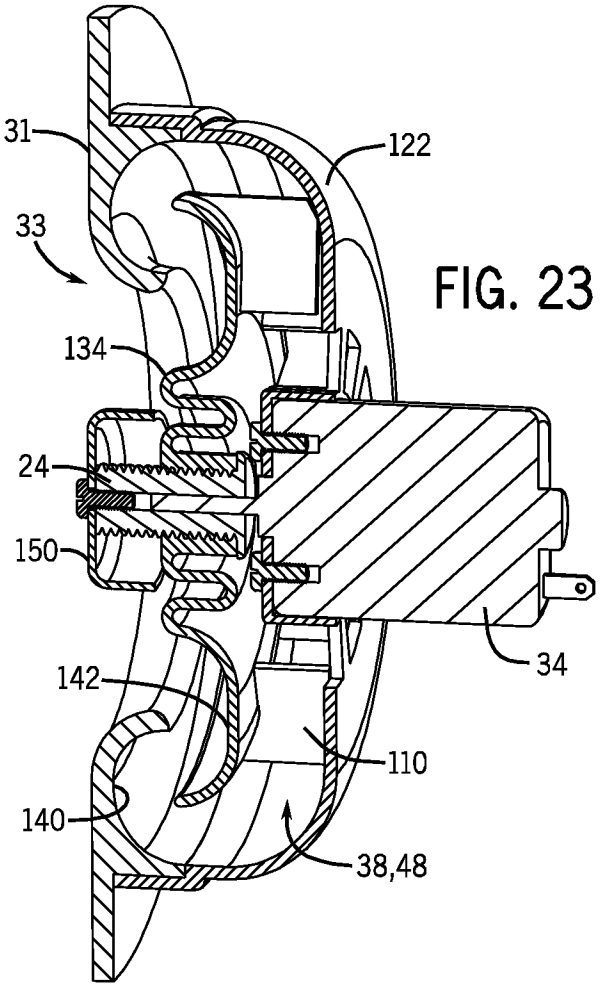
FIGS. 22 and 23 are figures similar to FIGS. 18 and 19 of an embodiment combining the fan and the vent plate on a single structure.
Figure 22:
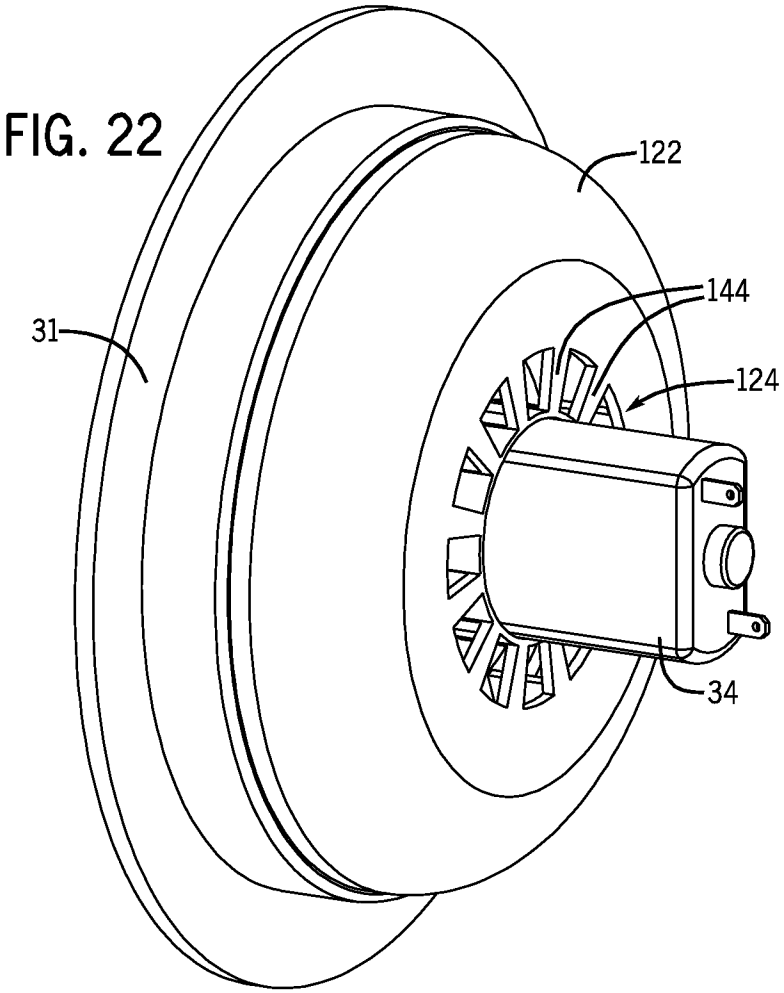
Figure 25:
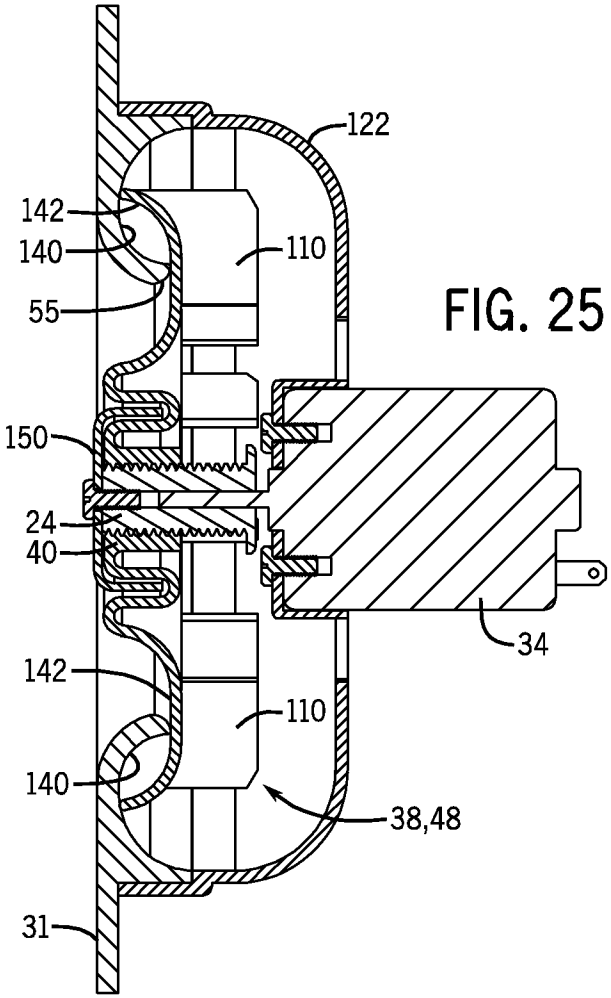
FIGS. 24 and 25 are elevational cross-section views of the embodiments of FIGS. 22 and 23 in the open and close position respectively.
Figure 24:
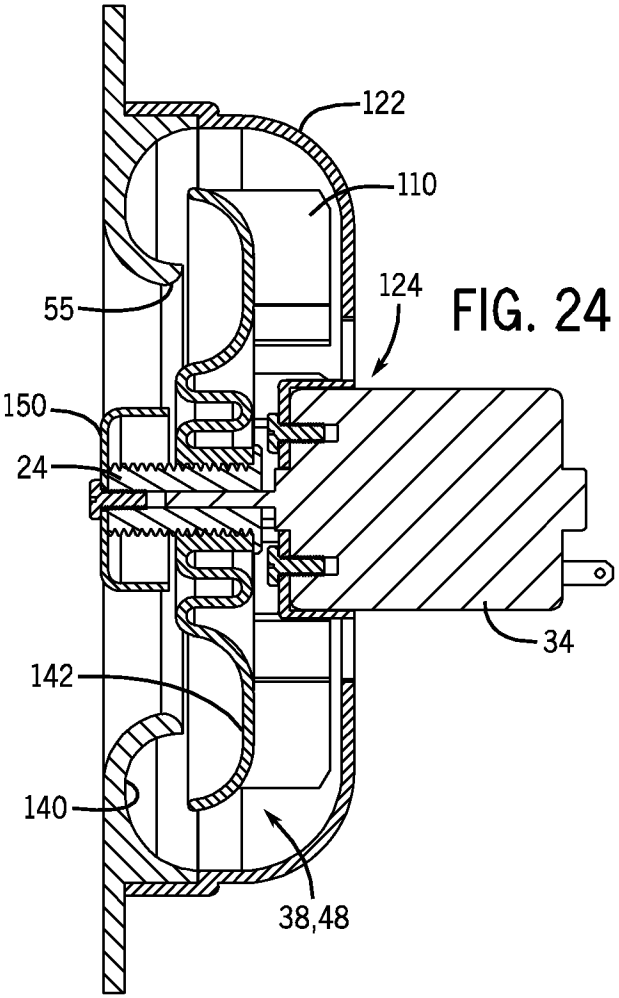

Referring now to FIGS. 16 and 17, in an alternative embodiment the collar 40 may be locked to the shaft 17 of the motor 34 dispensing with the helical drive 24. In this embodiment, the shaft 17 may move axially along axis 32 by an amount necessary to open the valve disk 48. The motor rotor 112 attached to the shaft 17 may be offset along axis 32 downward from the center of the motor 34 with the effect of gravity as shown in FIG. 16 or an auxilary spring (not shown). This downward offset displaces the rotor 112 from a magnetically stable position centered within the motor housing and aligned with the motor stator when the motor is being run, and serves to close the valve disk 48 against the upper lip 50 under the force of gravity. When the motor 34 is energized, the rotor 112 seeks its stable position upward in the motor 34 aligned with the stator causing the shaft 17 to rise pulling up on the collar 40. Per the embodiment of FIGS. 14 and 15, the collar 40 may be fixed rotatably to the hub 39 and the fan 38 so that raising of the shaft 17 pulls the fan 38 into position within the shroud 58 and simultaneously rotates the fan 38. Generally, the motor 34 may be operated in either direction to open the valve disk 48. This optionally allows this design to be used either to draw air out of or blow air into the wash cavity as desired. The motor 34 may be, for example, an AC shaded pole motor or the like.

Referring now to FIGS. 18-21, in an alternative embodiment, the vent fan assembly 29 may be covered by a dome shaped shell 122 having an arcuate interior wall enclosing a volume containing the fan 38 and the valve disk 48. The shell 122 connects to the housing 31 outside of the shroud/valve seat 35 so as not to interfere with airflow through passageway 33. The shell 122 further provides an opening 124 at an upper end near the motor 34, for example in the form of a circle, for allowing air passage there through when the vent fan assembly 29 is in a opened position. The motor 34 may be suspended in the opening 124 by a mounting bracket 126, which is affixed to the housing 31 at a first and second attachment pylon 128.

As described generally above with respect to FIGS. 12-15, the valve disk 48 may be supported on a collar 40 that threadably engages a helical drive 24 driven by the motor 34. The valve disk 48 may have upwardly extending air paddles 110 attached thereto to engage in air held within the volume of the shell 122. This air will tend to restrain rotation of the valve disk 48 with respect to the helical drive 24 causing the valve disk 48 to rise away from the shroud/valve seat 35 with a first direction of motor operation and causing the valve disk 48 to fall toward the shroud/valve seat 35 with a second direction of motion.

A resilient seal 130, such as an O-ring, may be supported near the upper lip 50 of the shroud/valve seat 35 so that when the valve disk 48 moves downward it compresses the resilient seal 130 to improve the sealing between the valve disk 48 and the shroud/valve seat 35.

A collar 40 providing internal threads engaging the external threads of the helical drive 24 may provide for the connection between the helical drive 24 and the valve disk 48 through a bellows 134 formed concentrically about the axis of the helical drive 24 on the valve disk 48. The bellows 134 provides for a spring biased translation of the valve disk 48 along the axis of rotation with respect to the collar 40 so as to equalize pressure between the valve disk 48 and the resilient seal 130 and to reduce jamming forces between the collar 40 and the helical drive 24 when the valve disk 48 abuts the seal 130.

Referring now to FIGS. 22-25, in a further embodiment, the resilient seal 130 described above may be eliminated while providing resistance to the passage of water and air through the vent fan assembly 29 when it is in the closed state by providing an overlapping engagement between the valve disk 48 and the shroud/valve seat 35 that provides a serpentine pathway between the two that resists water flow when the valve disk 48 is in the closed or nearly closed position. Specifically, the housing 31 provides a circular channel 140 outside and surrounding the shroud/valve seat 35 and concave upward toward the motor 34. Conversely, the valve disk 48 provides a circular channel 142 at its outer periphery concave downward away from the motor 34 and staggered with respect to the circular channel 140 so that the two engage each other with a lowermost edge of the valve disk 48 contacting a center of the channel 140 and upper edge 55 of the channel 140 contacting a center of the channel 142.

In this embodiment, the motor 34 may be supported directly on the shell 122 by means of radially inwardly extending support struts 144 passing through the opening 124. The air paddles 110 extending from the upper surface of the valve disk 48 also provide the fan 38 so that both are joined on the same structure attached to collar 40. When the helical drive 24 rotates in a first direction, the drag of the air paddles 110 against the air causes the collar 40 to rise upward on the helical drive 24 toward the motor 34 opening the passageway 33 for airflow downward through the passageway 33. This air is impelled centrifugally by the rotation of the air paddles 110 when upward motion of the collar 40 is stopped by the threads causing the air paddles 110 to rotate. The radially expelled air is guided by the shell 122 through the open and overlapping channels 140 and 142. When the helical drive 24 rotates in a second opposite direction, the drag of the air paddles 110 against the air causes the collar 40 to descend downward on the helical drive 24 away from the motor 34 closing the passageway 30 also for airflow downward through the passage. Downward motion of the fan 38 and valve disk 48 is prevented by an end cap 150 positioned at the end of the helical drive 24 furthest from the motor 34.

Significantly, either direction of rotation of the motor 34 will generate the same centrifugal action and downward airflow thus preventing any draw of moisture upward into the motor area regardless of the rotation direction of the motor 34. The elimination of the elastomeric seal and the use of the restricted serpentine channel formed between channels 140 and 142 prevents stalling of the motor in this closed position allowing simple open loop control of the opening and closing of the vent fan assembly 29 by timing of a control circuit.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

The recitation of a fan in the present invention should be understood to broadly include rotating elements for air movement including propeller type fans and squirrel cage type of blowers.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A washing-appliance vent comprising:

a housing having an inlet adapted to communicate with a washing volume for receiving items to be washed, and an outlet communicating with air outside of a washing appliance, the housing including a channel for permitting airflow therethrough between the inlet and the outlet;

an electrical motor providing a rotating shaft extending along an axis;

a fan attached to the electrical motor and positioned within the channel, the fan rotatable by the electrical motor in a first direction to move air through the channel from the inlet to the outlet;

a vent cover movable between a closed position blocking the channel to prevent airflow therethrough and an open position opening the channel to permit the airflow therethrough; and a mechanical coupling positioned between the motor and the cover and operating to open the vent cover when the electrical motor rotates the fan in the first direction caused by the rotation in the first direction and using energy supplied by the motor to open the vent cover;

wherein the mechanical coupling provides a first engagement state connecting two portions of the coupling to move the vent cover to from the closed position to the open position by rotation of the fan in the first direction and a second slipping state allowing slippage between the two portions of the coupling with rotation of the fan in the first direction without moving the vent cover.

2. The washing-appliance vent of claim 1 wherein the mechanical coupling further operates to close the vent when the electrical motor rotates the fan in a second direction opposite the first direction.

3. The washing-appliance vent of claim 2 further including a vent control providing a first polarity of electrical power to the electrical motor to cause the fan to move in the first direction when venting of the washing appliance is to occur and providing a second opposite polarity of electrical power to the electrical motor to cause the fan to move in the second direction when washing within the washing appliance is to occur.

4. The washing-appliance vent of claim 1 further including a spring element urging the vent cover to the closed position when no power is applied to the electrical motor.

5. The washing-appliance vent of claim 1 wherein the rotating shaft of the electric motor may move axially allowing an internal rotor of the electric motor to move out of alignment with an internal stator when the electric motor is de-energized and to move into alignment with an internal stator when the electric motor is energized and wherein the mechanical coupling connects the vent cover to the shaft to move axially therewith to open the vent when the electric motor rotates the fan in the first direction.

6. The washing-appliance vent of claim 1 wherein the vent cover is a plate slidable across the channel and substantially perpendicular to airflow to cover or uncover an exit port in the housing.

7. The washing-appliance vent of claim 6 wherein the plate includes multiple openings spaced along the plate and the exit port includes multiple apertures spaced along the exit port and alignable with the multiple openings so that movement of the plate with respect to the exit port may move the vent from open to closed.

8. The washing-appliance vent of claim 1 wherein the vent cover includes a plurality of blades causing a torsion between the fan and the vent cover driving the mechanical coupling and wherein the mechanical coupling is a threaded coupling between the rotating shaft and the vent cover, allowing the vent cover to rotate on the rotating shall to move between the open and closed positions.

9. The washing-appliance vent of claim 8 further including a spring element between a portion of the threaded coupling attached to the vent cover and the vent cover allowing a spring biased displacement of the vent cover along the rotating shaft when the vent cover engages the channel in the closed position.

10. The washing-appliance vent of claim 9 further including an elastomeric seal positioned at an interface between the vent cover and the channel when the vent cover is in the closed position.

11. A washing appliance vent comprising:

a housing having an inlet adapted to communicate with a washing volume for receiving items to be washed, and an outlet communicating with air outside of a washing appliance, the housing including a channel for permitting airflow therethrough between the inlet and the outlet;

an electrical motor providing a rotating shaft extending along an axis;

a fan attached to the electrical motor and positioned within the channel, the fan rotatable in a first direction to move air through the channel from the inlet to the outlet;

a vent cover movable between a closed position blocking the channel to prevent airflow therethrough and an open position opening the channel to permit the airflow therethrough; and a mechanical coupling positioned between the motor and the cover and operating to open the vent cover when the electrical motor rotates the fan in the first direction;

wherein the mechanical coupling further operates to close the vent when the electrical motor rotates the fan in a second direction opposite the first direction;

further including a vent control providing a first polarity of electrical power to the electrical motor to cause the fan to move in the first direction when venting of the washing appliance is to occur and providing a second opposite polarity of electrical power to the electrical motor to cause the fan to move in the second direction when washing within the washing appliance is to occur;

wherein the mechanical coupling is selected from the group consisting of: a collar fitting about a threaded shaft and a follower pin received by threads of a threaded shaft attached to the motor.

12. The washing appliance vent of claim 11 wherein the collar attaches to a center of the vent cover to move the vent cover to engage or disengage from a vent cover seat concentric about the fan with rotation of the motor.

13. The washing appliance vent of claim 11 wherein the threaded shaft provides a non-threaded portion allowing rotation of the threaded shaft without movement of the collar at an extreme position of the collar with respect to the threaded shaft.

14. A washing appliance vent comprising:

a housing having an inlet adapted to communicate with a washing volume for receiving items to be washed, and an outlet communicating with air outside of a washing appliance, the housing including an channel for permitting airflow therethrough between the inlet and the outlet;

an electrical motor providing a rotating shaft extending along an axis;

a fan attached to the electrical motor and positioned within the channel, the fan rotatable in a first direction to move air through the channel from the inlet to the outlet;

a vent cover movable between a closed position blocking the channel to prevent airflow therethrough and an open position opening the channel to permit the airflow therethrough; and a mechanical coupling positioned between the motor and cover and operating to open the vent cover when the electrical motor rotates the fan in the first direction;

wherein the mechanical coupling is selected from the group consisting of: a collar fitting about a threaded shaft and a follower pin received by threads of a threaded shaft attached to the motor and wherein the vent cover and the fan are joined to the thread follower to rotate together therewith.

15. The washing appliance vent of claim 14 including a cowling surrounding the vent cover and fan to conduct centrifugally directed air from the fan blades through the channel from the inlet to the outlet in both of two directions of rotation of the motor.

16. The washing appliance vent of claim 14 further including a spring element between a portion of the threaded coupling attached to the vent cover and the vent cover allowing a spring biased displacement of the vent cover along the rotating shaft when the vent cover engages the channel in the closed position.

17. A method of venting a washing-appliance having a vent providing a housing having an inlet adapted to communicate with a washing volume for receiving items for washing, and an outlet communicating with air outside of a washing appliance, the housing including a channel for permitting airflow therethrough, an electrical motor providing a rotating shaft extending along an axis, a fan attached to the electrical motor and positioned within the channel and rotatable by the electrical motor in a first direction to move air through the channel from the inlet to the outlet, a vent cover movable between a closed position blocking the channel to prevent the airflow therethrough and an open position opening the channel to permit the airflow therethrough; and a mechanical coupling positioned between the motor and the vent cover to cause rotation of the electrical motor driving the fan in the first direction to open the vent, cover using energy supplied by the motor, wherein the mechanical coupling provides a first engagement state connecting two portions of the coupling to move the vent cover from the closed position to the open position with rotation of the fan in the first direction and a second slipping state allowing slippage between the two portions of the coupling with rotation of the fan in the first direction without moving the vent cover, the method comprising:

applying a first polarity of power to the fan to cause the fan to rotate in the first direction at a time when venting of the washing appliance is desired, the rotation of the motor in the first direction communicating through the mechanical coupling to cause an opening of the vent rover and a venting of the washing volume.

18. The method of claim 17 further comprising the step of applying a second polarity of power to the fan opposite the first polarity to cause the fan to rotate in a second direction at a time when no venting of the washing appliance is desired, the rotation of the motor in the second direction communicating through the mechanical coupling to cause a closing of the vent cover and a sealing of the washing volume.

19. A dishwasher comprising:

a dishwasher housing defining a washing volume for receiving dishes therein for washing;

a vent having a housing having an inlet adapted to communicate with the washing volume and an outlet communicating with air outside of the dishwasher, the housing including a channel for permitting airflow therethrough between the inlet and the outlet;

an electrical motor providing a rotating shaft extending along an axis;

a fan attached to the electrical motor and positioned within the channel and rotatable by the electrical motor in a first direction to move air through the channel from the inlet to the outlet;

a vent cover movable between a closed position blocking the channel to prevent airflow therethrough and an open position opening the channel to permit the airflow therethrough;

a mechanical coupling positioned between the motor and the vent cover to cause rotation of the electrical motor driving the fan in the first direction to open the vent cover using energy supplied by the electrical motor, wherein the mechanical coupling provides a first engagement state connecting two portions of the coupling to move the vent cover to from the closed position to the open position with rotation of the fan in the first direction and a second slipping state allowing slippage between the two portions of the coupling with rotation of the fan in the first direction without moving the vent cover; and a cycle timer providing a first polarity of electrical voltage to the motor during a vent cycle stage to cause motion of the motor in the first direction and an opening of the vent.

20. The dishwasher of claim 19 wherein the mechanical coupling further causes rotation of the electrical motor to drive the fan in a second direction opposite the first direction to close the vent and wherein the cycle timer provides a second opposite polarity of electrical power to the electrical motor during a non-vent cycle stage causing the fan to move in the second direction when washing of the dishes within the dishwasher is to occur, causing a closing of the vent.

* * * * *